United States Patent [19]

Thibodeau

[11] 3,999,175

[45] Dec. 21, 1976

[54] FAULT DETECTION INDICATION SYSTEM

[76] Inventor: Joseph C. Thibodeau, Box 393B, Rte. 38, Pelham, N.H. 03076

[22] Filed: July 31, 1975

[21] Appl. No.: 600,823

[52] U.S. Cl. ..... 340/253 R; 340/256

[51] Int. Cl.[2] ..... G08B 21/00

[58] Field of Search ..... 340/253 R, 256, 213 R, 340/415; 317/154; 98/115 R, 115 K; 126/249, 250

[56] References Cited

UNITED STATES PATENTS 2,719,966 10/1955 Schurr ..... 340/415

*Primary Examiner*—John W. Caldwell
*Assistant Examiner*—Daniel Myer
*Attorney, Agent, or Firm*—Pearson & Pearson

[57] ABSTRACT

A fault detection and indication system for electrically energized apparatus. The system connects to a number of sensors which actuate series switches in a power supply control circuit for the apparatus. If any switch contacts open, the control circuit deenergizes the apparatus. The fault detection and indication system connects to these switches and displays the status of the switches by means of first and second indicator lights.

1 Claim, 2 Drawing Figures

FAULT DETECTION INDICATION SYSTEM

BACKGROUND OF THE INVENTION

This invention relates to a system for detecting and indicating various malfunctions in electrically operated apparatus of the type normally found in manufacturing facilities. More specifically, this invention relates to a system which displays and isolates the source of abnormal operating conditions in such apparatus.

It is common for electrical apparatus used in manufacturing facilities, such as heaters or drying ovens, to include a variety of sensors to monitor various operating conditions or parameters. These parameters include, for example, stack temperatures, stack and fuel pressures, and fan operation. If a value of a particular parameter goes outside a predetermined safe range of values, the sensor opens a corresponding switch in the power supply control circuit thereby to open a main contactor and deenergize the apparatus.

Commonly a facility may have several pieces of this apparatus distributed throughout a large area and each piece may have many such sensors associated with it. Moreover, this apparatus often operates without anyone in attendance. When a sensor does turn off an oven, a monitoring system should indicate which sensor, or group of related sensors, monitored the abnormal condition. Sometimes the abnormal condition is intermittent, so it is desirable that any such system indicates the sensor or group of sensors which turns the apparatus off. Such isolation reduces overall operating costs because actual repair times are reduced by minimizing the time necessary to diagnose the problem.

There are diverse detection and indication systems for connection to such apparatus. In one, a transformer connects to a set of switch contacts and to an indicator circuit. When a switch opens in response to a condition, it energizes the corresponding transformer and indicator circuit.

In another system adopted for detecting ground or similar faults in a cable, a fault causes an intermittent high current. A reed switch and photoelectric latching circuit energizes a lamp thereby to indicate a fault condition. If a number of these indicators are juxtaposed to the cable, all lamps on one side of the fault will be lit thereby simplifying the fault location.

These prior systems are somewhat complex so they tend to be expensive because the transformers and latching circuits are duplicated at each sensor.

Consequently, it is an object of this invention to provide a system for isolating malfunctions in complex electrical apparatus.

It is another object of this invention to provide an inexpensive and reliable means for monitoring the operation of plant equipment.

SUMMARY

I provide a fault detection and indication system which isolates and displays malfunctions in complex electrical apparatus in a manufacturing facility. The apparatus to which the present invention may be applied include a control circuit having serially connected, normally closed switches which deenergize the apparatus whenever a fault occurs. My fault detection and indication system includes a plurality of relays. Each relay is connected to a sensor switch or group of switches. So long as the switches are closed, the apparatus is energized and the relays turn on a first light which indicates proper operation. When a malfunction occurs, one sensor switch opens. This immediately deenergizes all relays on the load side of that switch. Consequently these deenergized relays are latched and energize second lights. The resultant pattern of lights thereby isolates the malfunction to one sensor or a group of sensors. Moreover, the pattern remains until the fault is corrected and the operator resets the system.

This invention is pointed out with particularity in the appended claims. The above and further advantages of this invention may be better understood by referring to the following description in conjunction with the accompanying drawings.

DESCRIPTION OF AN ILLUSTRATIVE EMBODIMENT

Figure 1:
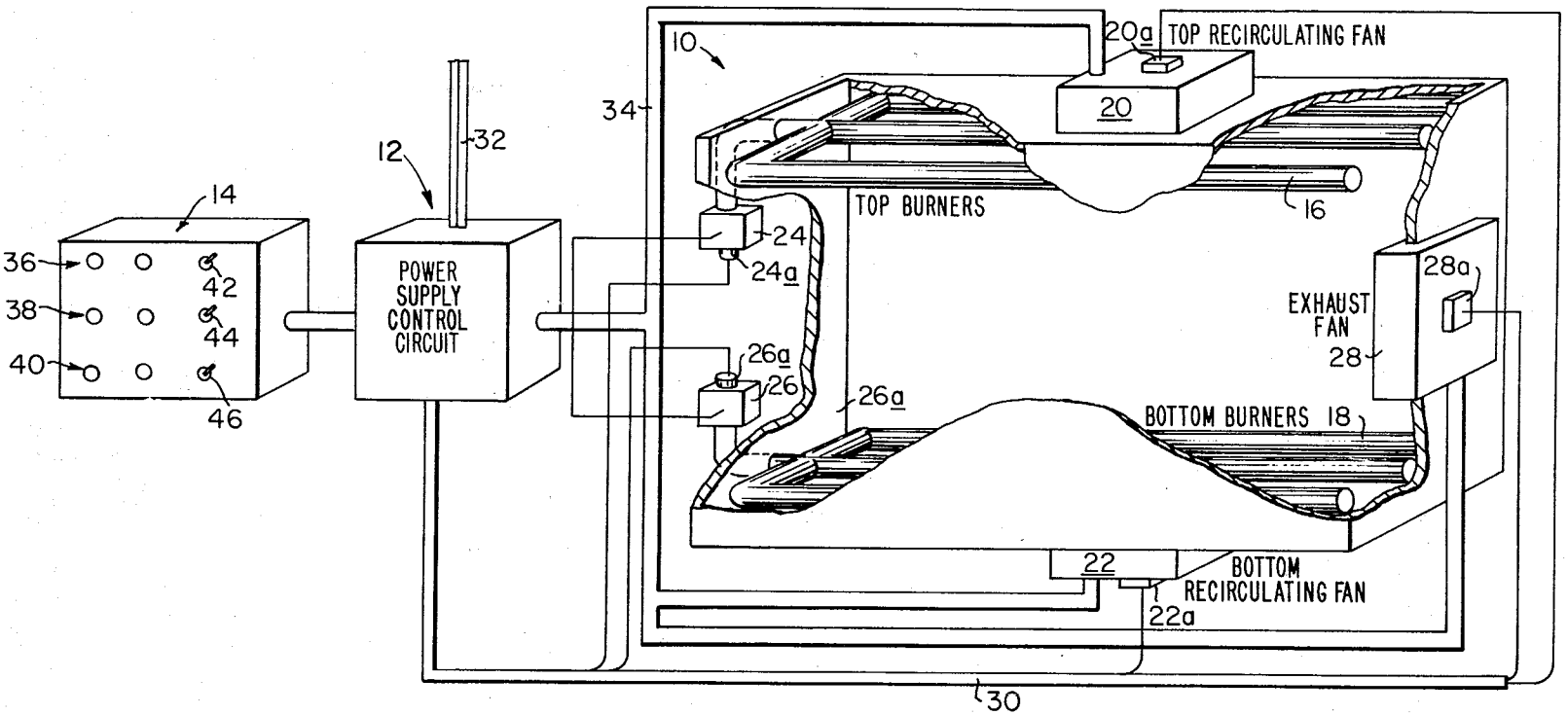
FIG. 1 is a diagram of a manufacturing facility utilizing the present fault detection and indication system.

FIG. 1 depicts a fault detection and indication system embodying my invention together with an oven which is typical of the electrical apparatus to which the system may connect. A power supply control circuit 12, which may include one or electromagnetically operated contactors applies electrical power to various heating and fan elements in the oven 10. My detection and indication unit 14 connects to the control circuit 12 and to sensors associated with the heating, fan and other elements at the oven 10. When a sensor indicates abnormal operation, it causes the control circuit 12 to deenergize the oven 10 and, in addition, displays a light pattern which isolates the sensor and corresponding oven element.

A typical oven 10 might comprise top burners 16 and bottom burners 18. A top recirculating fan 20 and a bottom recirculating fan 22 continuously move the air in the oven 10 thereby to maintain an even temperature in the oven as depicted or, in some ovens, a heated chamber. Gas valves 24 and 26 open and close in response to signals from the control circuit 12 thereby to regulate the flow of gas to each of the burners 16 and 18. An exhaust fan 28 maintains a steady flow of air from the oven, either from the main chamber as shown or from a separate plenum. Associated with each of the fans 20, 22 and 28 are sensors **20*a*, 22*a* and 28*a*, respectively. Each sensor may comprise a bimetallic, normally closed switch. However, the switch opens if an over temperature condition exists at the corresponding fan. Likewise, gas valves 24 and 26 each include a gas valve sensor 24*a* and 26*a*. Each such sensor may comprise a diaphram switch which is normally closed, but which opens if the gas pressure falls below a safe limit. A bus 30 connects the sensors 20*a*, 22*a*, 24*a*, 26*a* and 28*a* to the control circuit 12**.

Electrical conductors from a bus 32 provide power to the control circuit 12 and bus 34 connects the control circuit to each of the oven fans.

My described detection and indicating unit 14 comprises three sets of indicator lights 36, 38 and 40. Juxtaposed reset buttons 42, 44 and 46 correspond, respectively, to light pairs 36, 38 and 40.

Figure 2:
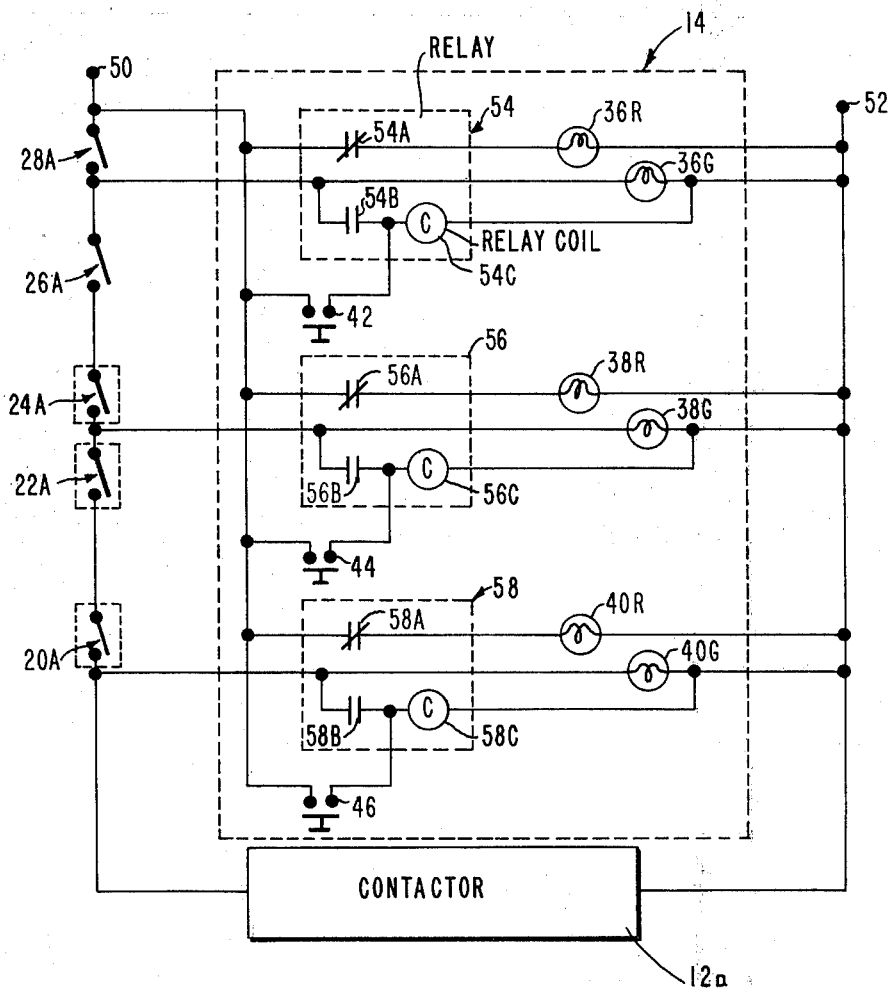
FIG. 2 is a schematic and block diagram of the fault detection and indication system.

Now referring to FIG. 2, a contactor **12*a*** in the control circuit has a coil which is energized when switches 20*a* through 28*a* close a circuit between the contactor 12*a* and power supply terminals 50 and 52.

The embodiment of the detection and indication unit 14 shown in FIG. 2 includes three single-pole, double-throw relays 54, 56 and 58 associated with the indicator light pairs 36, 38, and 40 and reset buttons 42, 44 and 46. Each circuit is similar, so only the circuit associated with lights 36 is described in detail. In that circuit, a relay 54 includes normally closed contacts 54A, normally opened contacts 54B and a coil 54C. The normally closed contact 54A couple a red, or other colored, warning light 36R between terminals 50 and 52 while the normally opened contacts 54B couple the coil 54C to the load side of sensor switch 28A. A green, or other colored, light 36G also connects to the load side of the switch 28A and to the terminal 52 thereby to indicate normal operation. The reset switch 42 connects the junction formed by the contacts 54B and coil 54C to the terminal 50.

Similarly, the corresponding parts of relays 56 and 58 connect to lights 38 and 40 respectively and terminals 50 and 52. However, in these relays the normally opened contacts 56B and 58B connect respectively to the load side of the switches 24A and 20A.

If the sensor switches are closed when the terminals 50 and 52 are energized, all the lights are energized, but the relay coils 54C, 56C and 58C are not energized. When the operator closes each of reset buttons 42, 44 and 46 in sequence, the lights 36R, 38R and 40R should turn off. Looking again at relay 54, closing the reset button 42 energizes relay coil 54C so the contacts 54A open and light 36R turns off. However, contacts 54B close and latch the relay into its energized condition.

If sensor switch 28A opens for any reason, the contactor 12a deenergizes the oven. In addition, all the relays and "green" lights on the load side of the switch 28A are deenergized. However, the normally closed contacts energize the "red" or warning lights so they turn on. The resulting pattern of the lights 36R, 38R and 40R indicates to an operator at the detection an indication unit 14 that a malfunction has occured and that it has most likely occured in the switch 28A.

After remedial action has been taken to correct the malfunction the operator can reapply power to the terminals 50 and 52 and actuate the reset switches 42, 44 and 46 in sequence. If the corresponding sensor switch remains closed, the red lights turn off so only the green lights are on. If however, the malfunction has not been corrected or any other malfunction occurs, the lights 36R, 38R and 40R go out only while their associated reset buttons 42, 44 and 46 are actuated. When the reset buttons are released their associated lights 36R, 38R and 40R come back on again indicating that further remedial action is required.

Thus, this system facilitates a diagnosis of problems because only red lights on the load side of an opened sensor switch on. For example, if sensor switch 22A opens, only red light 40R turns on. Lights 36R and 38R remain off and lights 36G and 38G remain on. The malfunction thus is isolated to switches 22A and 20A in this configuration.

It will also be apparent that other variations and modifications can be made to the specifically disclosed circuit. Therefore, it is the object of the present invention to cover such variations and modifications as come within the true spirit and scope of this invention.

What I claim as new and desire to secure by Letters Patent of the United States is:

1. A fault detection and indication system for use with electrical apparatus connected to a control circuit comprising a plurality of normally conductive, condition responsive switches for controlling the electrical apparatus, the electrical apparatus and the control circuit connected in series between first and second power supply terminals, the condition responsive switches having power contacts and load contacts, the power contacts being connected to receive electrical current from the first power supply terminal and the load contacts connected to deliver electrical current to said electrical apparatus, the switches being separated into a plurality of sets of one or more switches, said system comprising a detection and indication circuit corresponding to each set of switches, each said circuit comprising:

A. first lamp means connected between the second power supply terminal and the load contact of the corresponding switch set, B. normally conductive contact means, C. second lamp means connected in series with said normally conductive contact means between the first and second power supply terminals, whereby said first and second lamp means are energized when the corresponding switch set is conductive, D. latchable control means connected to said normally conductive contact means for latching open said normally conductive contacts, said control means connected between the second terminal of the power supply and the load contact of the corresponding switch set, and E. reset switch means connected to the first terminal of the power supply and said control means for energizing said control means whereby actuating said reset switch means energizes its corresponding control means to open said normally conductive contact means thereby to de-energize said second lamp means, the subsequent opening said switch set energizing said second lamp means and de-energizing said first lamp means.

* * * * *